US010493465B2

(12) United States Patent
Moore et al.

(10) Patent No.: US 10,493,465 B2
(45) Date of Patent: Dec. 3, 2019

(54) MEAT GRINDER WITH STORAGE TRAY AND COVER

(71) Applicant: Hamilton Beach Brands, Inc., Glen Allen, VA (US)

(72) Inventors: Devin Lee Moore, Decatur, GA (US); Brian Andrew Wong-Shui, Atlanta, GA (US); Timothy Richard Swiss, Carlsbad, CA (US)

(73) Assignee: Hamilton Beach Brands, Inc., Glen Allen, VA (US)

( * ) Notice: Subject to any disclaimer, the term of this patent is extended or adjusted under 35 U.S.C. 154(b) by 349 days.

(21) Appl. No.: 15/288,059

(22) Filed: Oct. 7, 2016

(65) Prior Publication Data

US 2018/0099289 A1 Apr. 12, 2018

(51) Int. Cl.
*B02C 18/30* (2006.01)
*B02C 18/36* (2006.01)

(52) U.S. Cl.
CPC ..... *B02C 18/30* (2013.01); *B02C 18/301* (2013.01); *B02C 18/305* (2013.01); *B02C 18/365* (2013.01)

(58) Field of Classification Search
CPC ... B02C 18/30; B02C 18/365; B02C 18/2258; B02C 18/2291; B02C 18/305; B02C 18/301; A47J 43/20; A47J 47/16
USPC ..... 241/82.1, 260.1, 100; 425/317, 472
See application file for complete search history.

(56) References Cited

U.S. PATENT DOCUMENTS 1,942,082 A 1/1934 Biancalana
1,951,826 A * 3/1934 Foster ..... B02C 18/305 241/37.5
2,087,474 A * 7/1937 Green ..... B02C 18/305 220/254.4
2,526,498 A 10/1950 Pacciano, Jr.
2,665,724 A 1/1954 Lundell
2,792,042 A 5/1957 Dwyer et al.
2,821,228 A * 1/1958 Hall ..... B02C 18/305 241/280
2,917,326 A * 12/1959 Lasar ..... B02C 18/305 241/82.1
3,014,515 A * 12/1961 Meeker ..... A47J 43/04 241/37.5
3,370,697 A * 2/1968 Levey ..... B25H 3/021 206/375
3,771,729 A 11/1973 Rrable
3,939,982 A * 2/1976 Russell ..... A45C 5/00 206/509
4,180,229 A 12/1979 Schulein
(Continued)

FOREIGN PATENT DOCUMENTS

CA 2865699 A1 * 5/2015 ..... B02C 18/305

*Primary Examiner* — Shelley M Self
*Assistant Examiner* — Bobby Yeonjin Kim
(74) *Attorney, Agent, or Firm* — Alexander D. Raring

(57) ABSTRACT

A food grinder comprises a base housing a motor, a throat portion coupled to the base, a receiving tube coupled to the throat, a feeding tray coupled to an upper end of the receiving tube, a selectively rotatable auger selectively insertable into and removable from the throat portion, and a storage tray sized and shaped to be selectively insertable into and removable from the feeding tray. The storage tray comprises a main body having a plurality of depressions formed in a top surface thereof. Each depression is sized and shaped to hold one or more accessories for use with the food grinder.

6 Claims, 7 Drawing Sheets

(56) References Cited

U.S. PATENT DOCUMENTS

| | | | | |
|---|---|---|---|---|
| 5,203,390 | A * | 4/1993 | Eckstein | A63B 53/14 150/160 |
| 6,460,791 | B1 | 10/2002 | Stehr | |
| 6,622,618 | B1 * | 9/2003 | Glucksman | A47J 43/24 210/360.1 |
| D511,930 | S * | 11/2005 | Wong | D7/376 |
| 7,207,510 | B2 | 4/2007 | Wong | |
| 7,237,547 | B1 * | 7/2007 | Bourgeois | A47J 36/26 126/38 |
| 8,550,692 | B1 * | 10/2013 | Brown | A47J 43/0711 366/129 |
| 2002/0008043 | A1 * | 1/2002 | Gunter | B65D 25/2897 206/278 |
| 2003/0129274 | A1 | 7/2003 | Garwood | |
| 2004/0129809 | A1 * | 7/2004 | Siano | A47J 43/06 241/92 |
| 2007/0040055 | A1 | 2/2007 | Riendeau et al. | |
| 2012/0205263 | A1 * | 8/2012 | Apps | B65D 1/243 206/162 |
| 2018/0071747 | A1 * | 3/2018 | Wight | B02C 23/10 |

* cited by examiner

MEAT GRINDER WITH STORAGE TRAY AND COVER

BACKGROUND OF THE DISCLOSURE

The present disclosure relates generally to appliances for food processing, and more particularly to food grinders and accessories therefor.

A food grinder is an appliance that reduces cooked or raw meat or other foods from large pieces. They are used for sausage production, grinding beef or game into ground patties, and the like. A food grinders typically comprises a vertical food chute and horizontal screw conveyor. Although not common, accessories can be assembled onto the food grinder, such as a stomper, sausage stuffer funnels, a funnel flange, a stuffing star, etc.

A food grinder may have ten or more such accessories. Keeping those accessories organized, so that they are not lost, and clean is a challenge. The grinder requires significant storage space alone, much less the various accessories, and consumer have long complained that such appliances require too much storage space. The food grinder of the following disclosure addresses the long felt need of efficiently storing food grinder accessories as well as other shortcomings with known grinders so as to overcome at least the above-described disadvantages of conventional food grinders.

BRIEF SUMMARY OF THE DISCLOSURE

A food grinder is disclosed herein. In one embodiment of the subject device, a food grinder comprises a base housing a motor, a throat portion coupled to the base, a receiving tube coupled to the throat, a feeding tray coupled to an upper end of the receiving tube, a selectively rotatable auger selectively insertable into and removable from the throat portion, and a storage tray sized and shaped to be selectively insertable into and removable from the feeding tray. The receiving tube is for receiving food to be ground and introducing the food to be ground into the throat portion. The feeding tray is for receiving the food to be ground and introducing the food to be ground into the receiving tube. The feeding tray comprises a floor, a wall projecting upward from a perimeter of the floor, and an open top end. The storage tray comprises a main body having a plurality of depressions formed in a top surface thereof. Each depression is sized and shaped to hold one or more accessories for use with the food grinder.

The storage tray may further comprise one or more handles projecting upward from the main body such that the one or more handles extend above the top end of the feeding tray when the storage tray is selectively inserted into the feeding tray.

The feeding tray may further comprise a guard mounted to a top edge of the wall such that the guard blocks a portion of the open top end of the feeding tray. The storage tray may be sized and shaped to be selectively insertable into and removable from the feeding tray via the unblocked portion of the open top end.

One or more of the plurality of depressions may be shaped, sized, and/or positioned such that at least a portion of at least one accessory overhangs a side edge of the storage tray and extends between the guard and the floor of the feeding tray.

The food grinder may further comprise a cover that is selectively positionable on and removable from the open top end of the feeding tray, such that the cover blocks the open top end when selectively positioned thereon. The cover may comprise a drawstring for securing the cover to the feeding tray.

BRIEF DESCRIPTION OF THE SEVERAL VIEWS OF THE DRAWINGS

The foregoing summary, as well as the following detailed description of the disclosure, will be better understood when read in conjunction with the appended drawings. For the purpose of illustrating the disclosure, there are shown in the drawings embodiments which are presently preferred. It should be understood, however, that the disclosure is not limited to the precise arrangements and instrumentalities shown. In the drawings.

DETAILED DESCRIPTION OF THE DISCLOSURE

Figure 1:
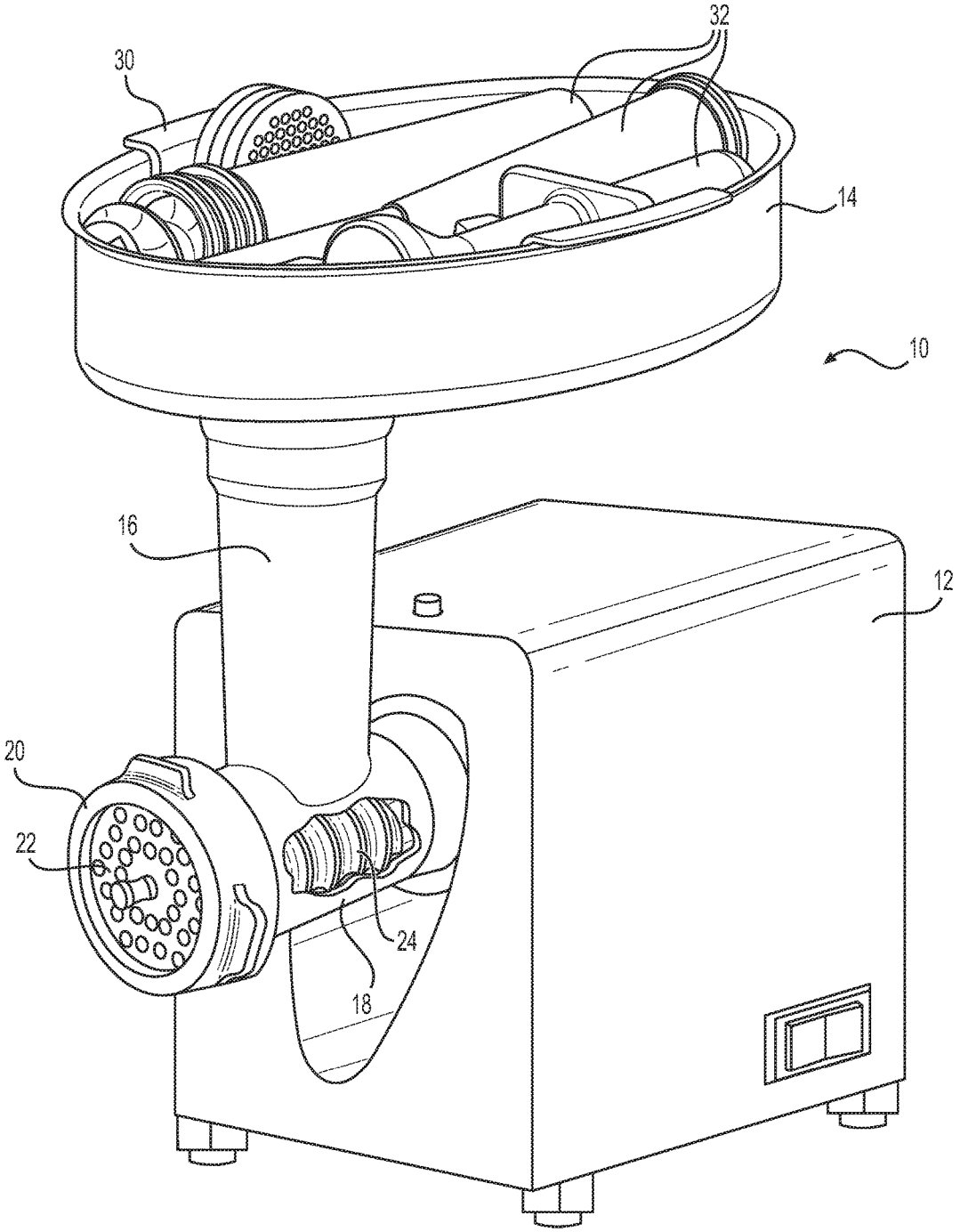
FIG. 1 is a perspective view of a food grinder with a storage tray holding a plurality of accessories, according to one embodiment of the invention.
Figure 2:
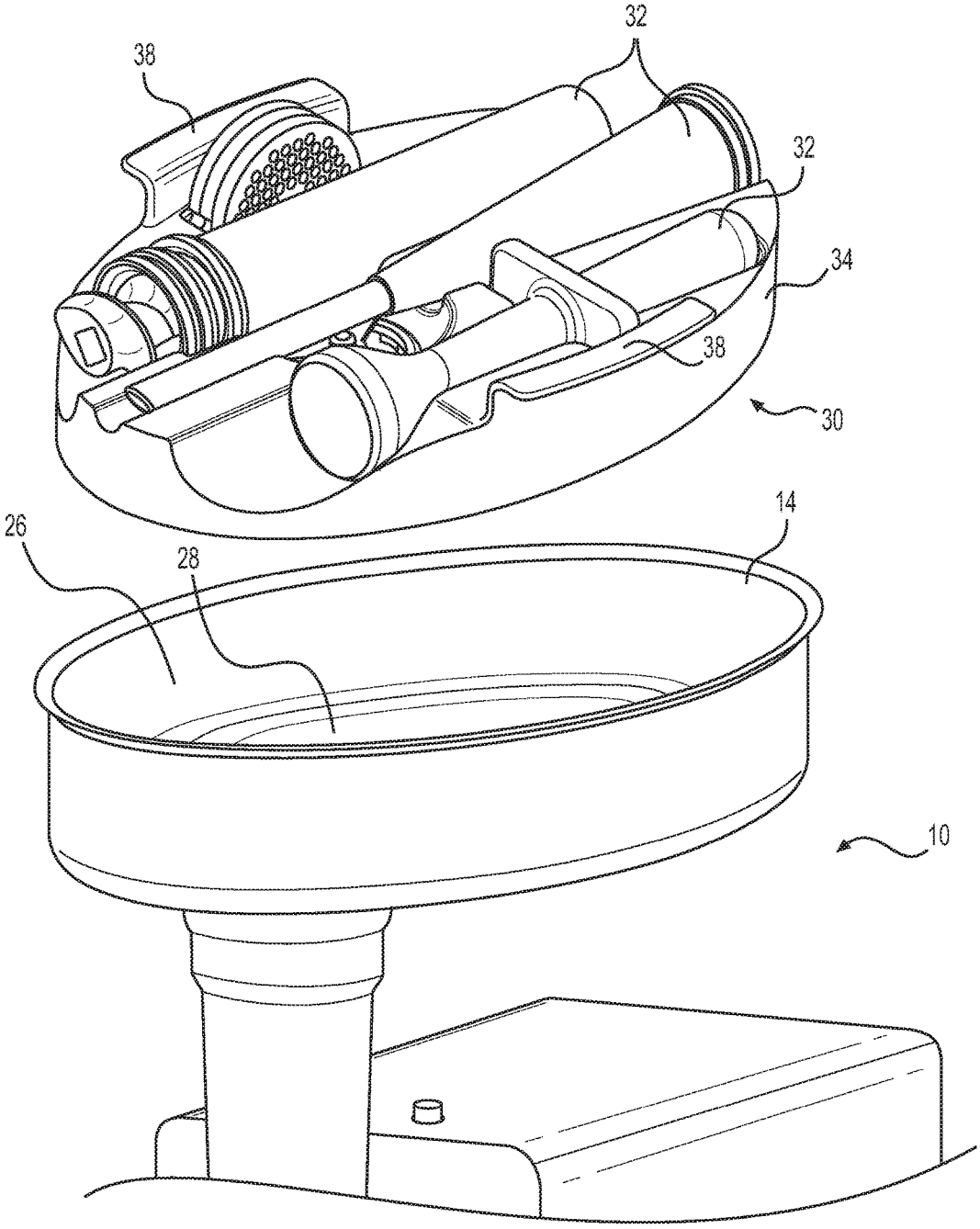
FIG. 2 is a perspective view of the food grinder and storage tray of FIG. 1, in a separated position.
Figure 3:
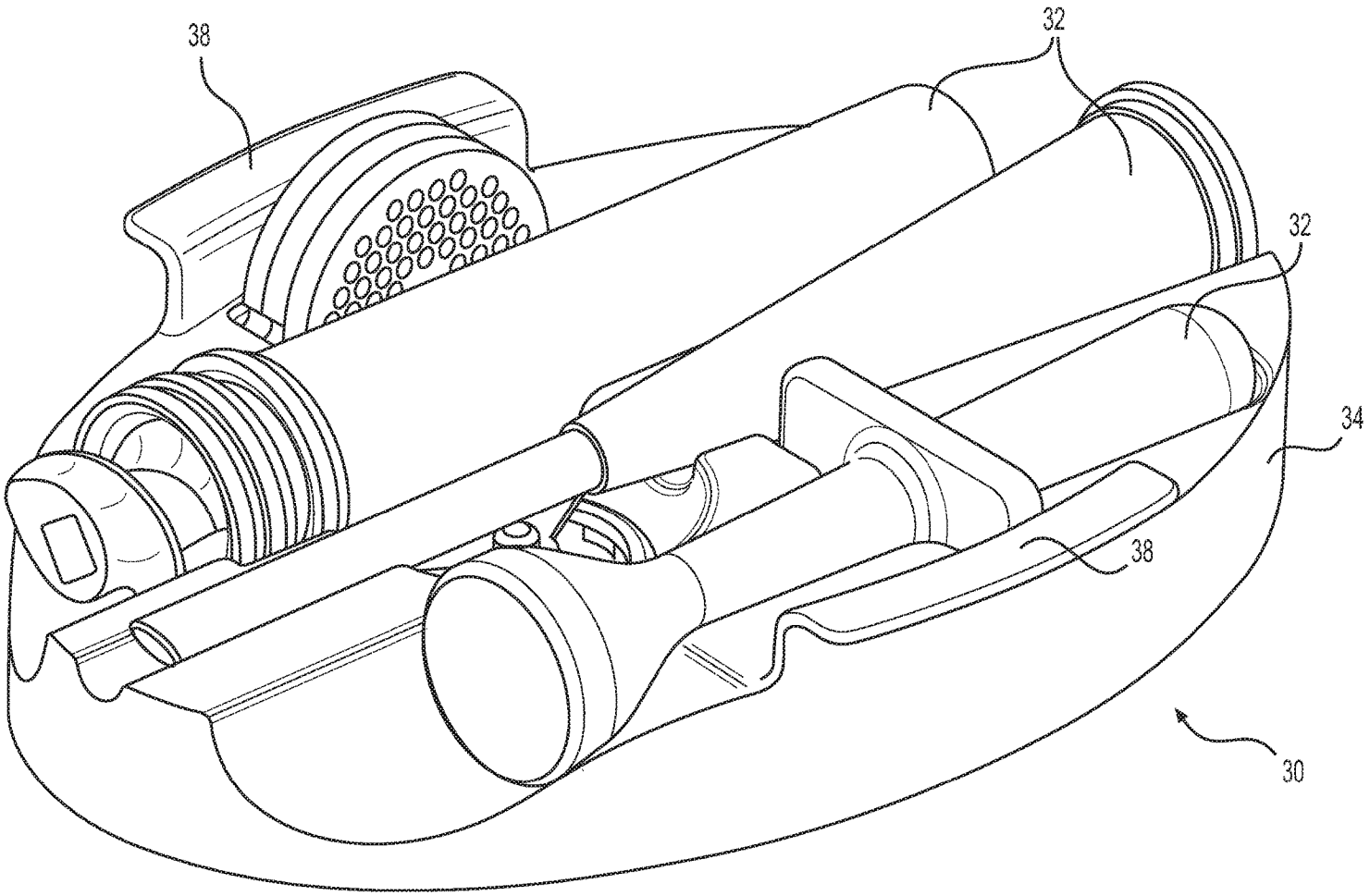
FIG. 3 is a top perspective view of the storage tray and accessories of FIG. 2 removed from the food grinder.
Figure 4:
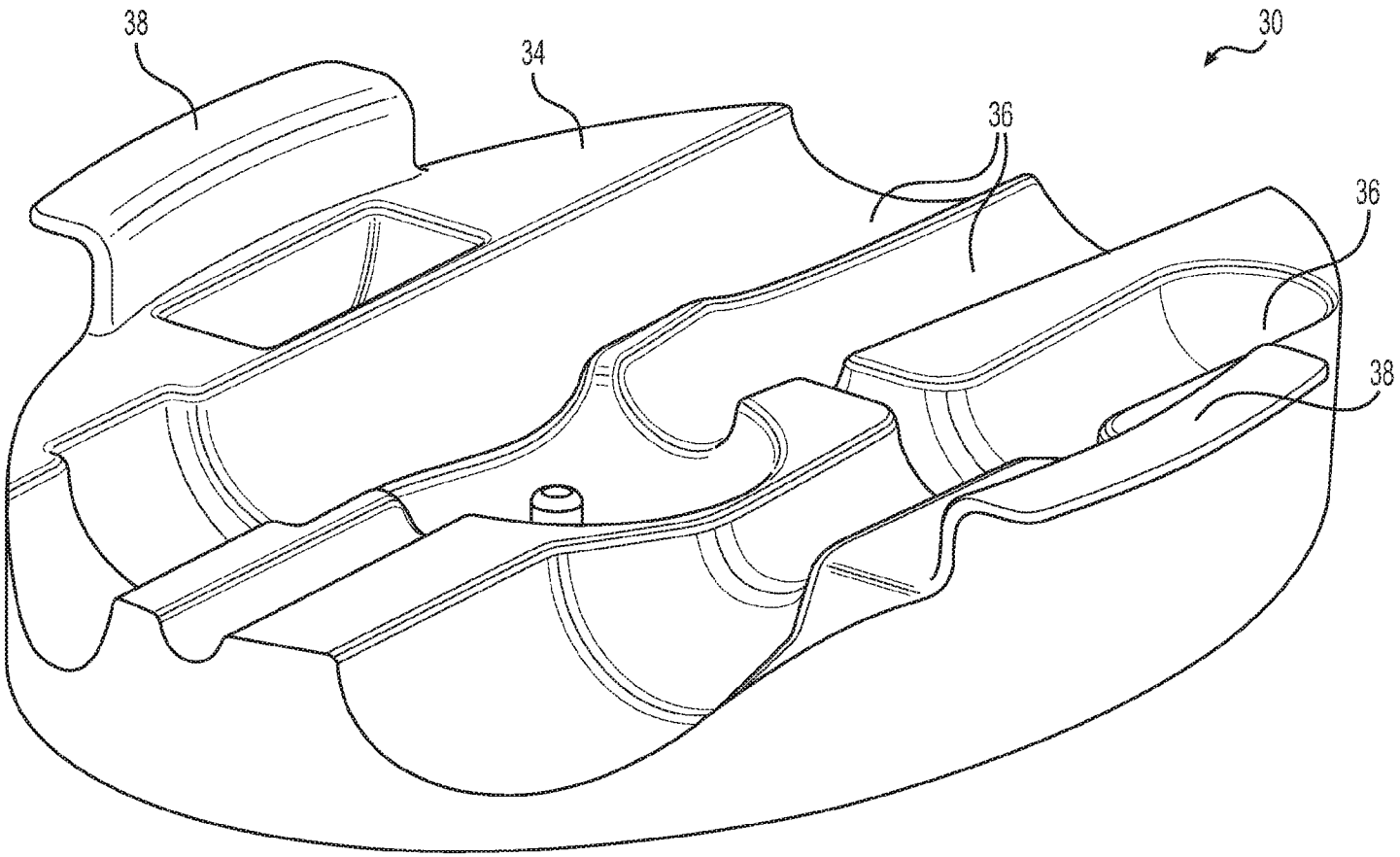
FIG. 4 is a top perspective view of the storage tray of FIG. 2 removed from the food grinder, with the accessories removed.
Figure 5:
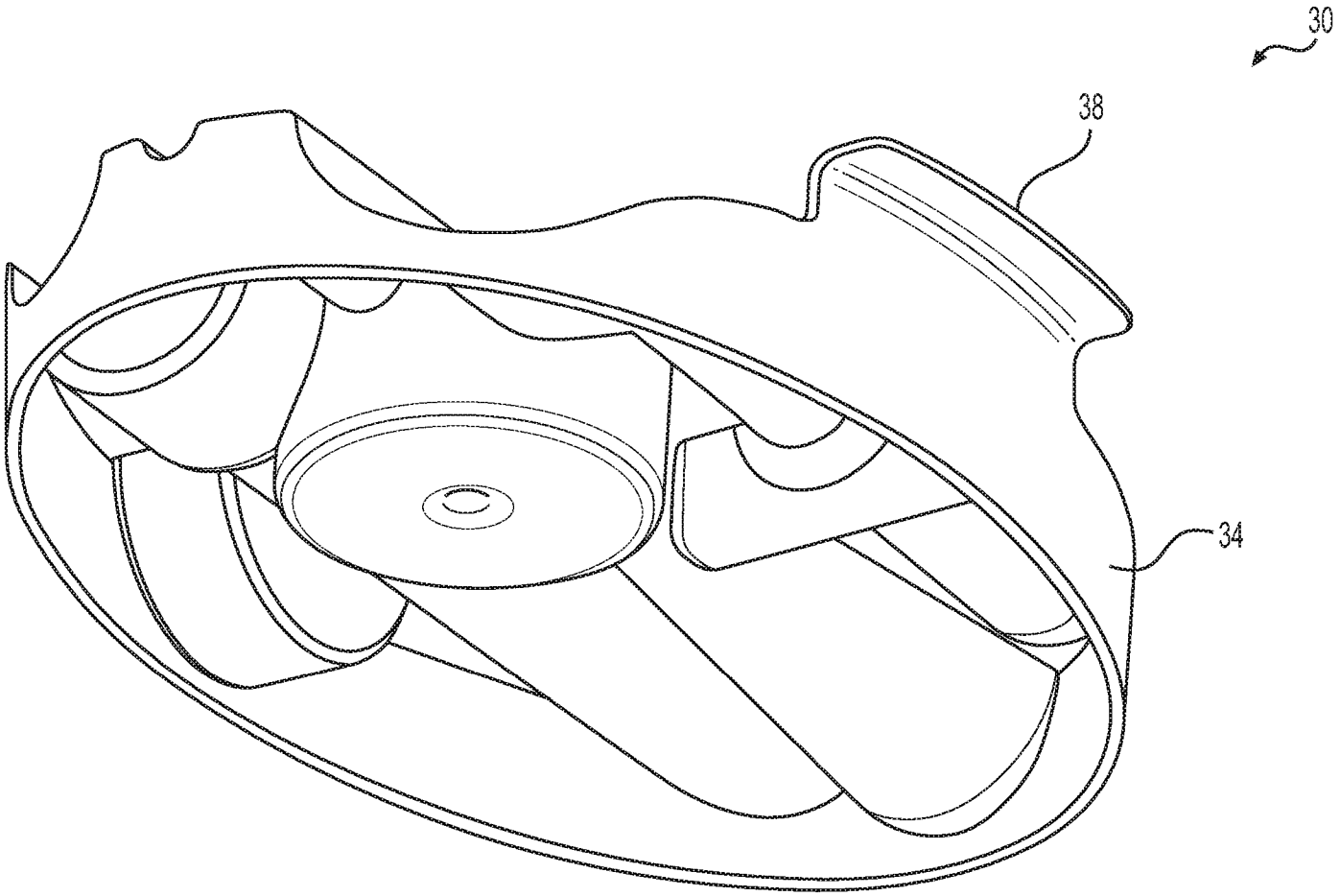
FIG. 5 is a bottom perspective view of the storage tray of FIG. 2 removed from the food grinder, with the accessories removed.

Certain terminology is used in the following description for convenience only and is not limiting. The words "lower," "bottom," "upper," and "top" designate directions in the drawings to which reference is made. The words "inwardly," "outwardly," "upwardly" and "downwardly" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like numerals indicate like elements throughout, FIGS. 1-5 illustrate a food grinder in accordance with a preferred embodiment of the present disclosure. The food grinder 10 of embodiments of the present disclosure comprises a base 12 housing a motor (not illustrated), a throat portion 18 coupled to the base, a receiving tube 16 coupled to the throat, and a feeding tray 14 (also termed a hopper tray) coupled to an upper end of the receiving tube 16. The feeding tray 14 comprises a wall 26 and a floor 18. Food to be ground may be placed on the feeding tray 14 and directed toward a hole (not illustrated) that leads to the receiving tube 16. The food to be ground travels down the receiving tube 16 and into the throat portion 18. A selectively rotatable auger 18 is inserted into the throat portion, such that a shaft at the inner end of the auger engages with the motor. The auger has a spiraling main body for propelling food. A rotating blade (not illustrated) is placed on the outer end of the auger shaft. A disk or plate 22 with a plurality of holes (different disks are typically available with different sizes holes) is placed on the outer end of the auger shaft. A locking nut 20 is screwed or otherwise affixed onto the end of the throat portion 18 to secure the disk 22, the blade, and the auger in place. In use, the motor rotates the auger and the blade. The food that is pushed down into the receiving tube 16 to the throat portion 18 is propelled by the rotating auger toward and past the blade, which grinds the food, and out through the disk 22.

Advantageously, the food grinder 10 comprises a storage tray 30 sized and shaped to be selectively insertable into and removable from the feeding tray 14. In the food grinder of FIGS. 1-5, the feeding tray 14 is oval and the storage tray 30 is correspondingly oval. The feeding tray and storage tray may have any suitable corresponding shapes. The storage tray 30 comprises a main body 34 having a plurality of depressions 36 formed in a top surface thereof. Each depression 36 is sized and shaped to hold one or more accessories 32 for use with the food grinder. The storage tray may include depressions to hold any suitable number and type of accessory. Multiple depressions may together hold one accessory.

The storage tray 30 comprises handles 38 projecting upward from opposing sides of the main body 34. As seen in FIG. 1, the handles 38 extend above the top end of the feeding tray when the storage tray 30 is selectively inserted into the feeding tray 14. The handles may project straight upward, or may have an outward bend as seen in FIGS. 1-5. Any other suitable handle configuration may be used, or the storage tray may have no handles.

Figure 6:
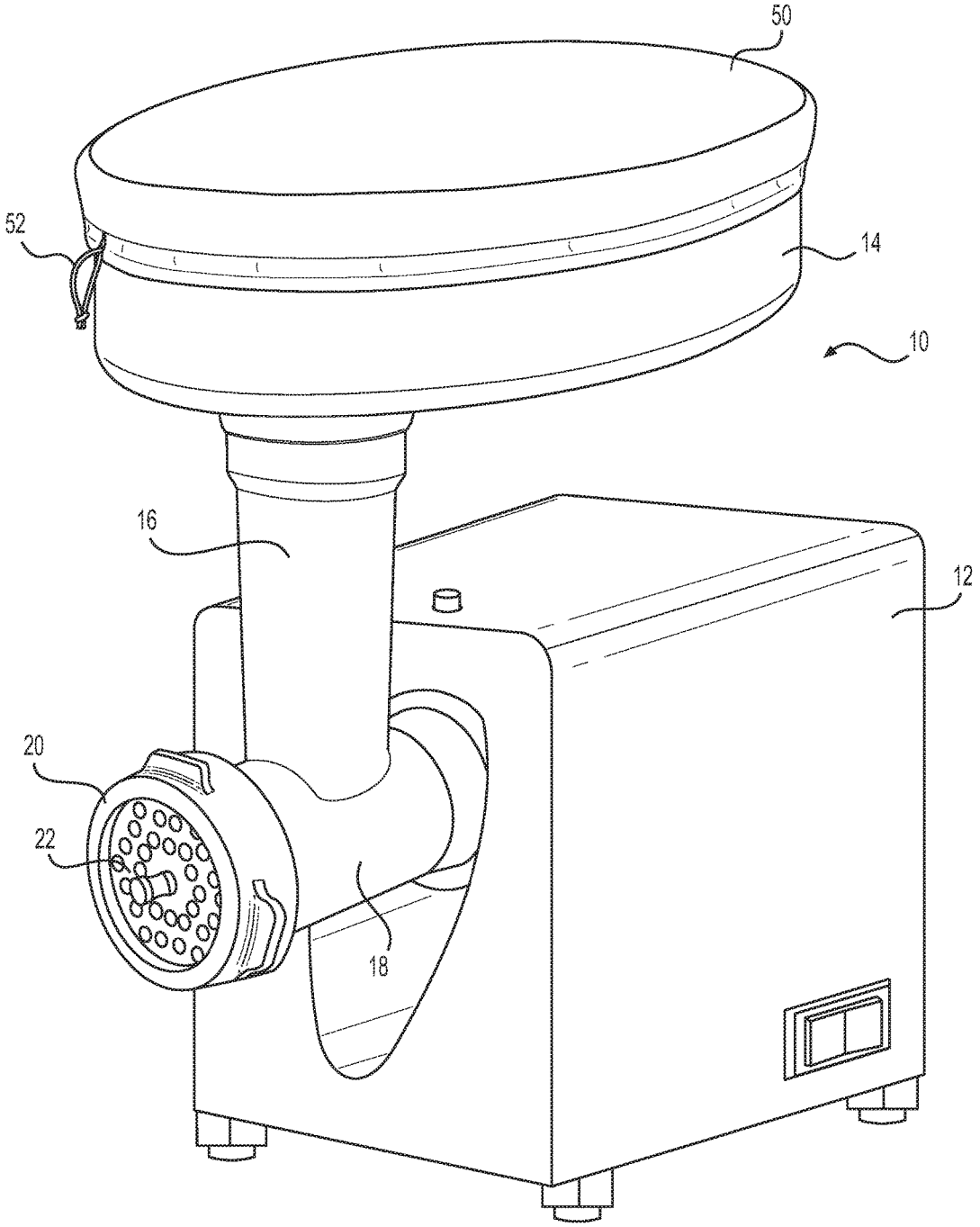
FIG. 6 is a perspective view of the food grinder of FIG. 2, with a feeding tray cover in place.

Referring now to FIG. 6, the food grinder 10 of embodiments of the present disclosure may optionally include a cover 50 that is selectively positionable on and removable from the open top end of the feeding tray 14, as seen in FIG. 6. Such a cover blocks the open top end when selectively positioned thereon, to help protect and keep clean the accessories and the feeding tray. The cover may be constructed of any suitable material or combination of materials, natural or synthetic. The cover may comprise a drawstring 52, or any other suitable mechanism for securing the cover to the feeding tray.

Figure 7:
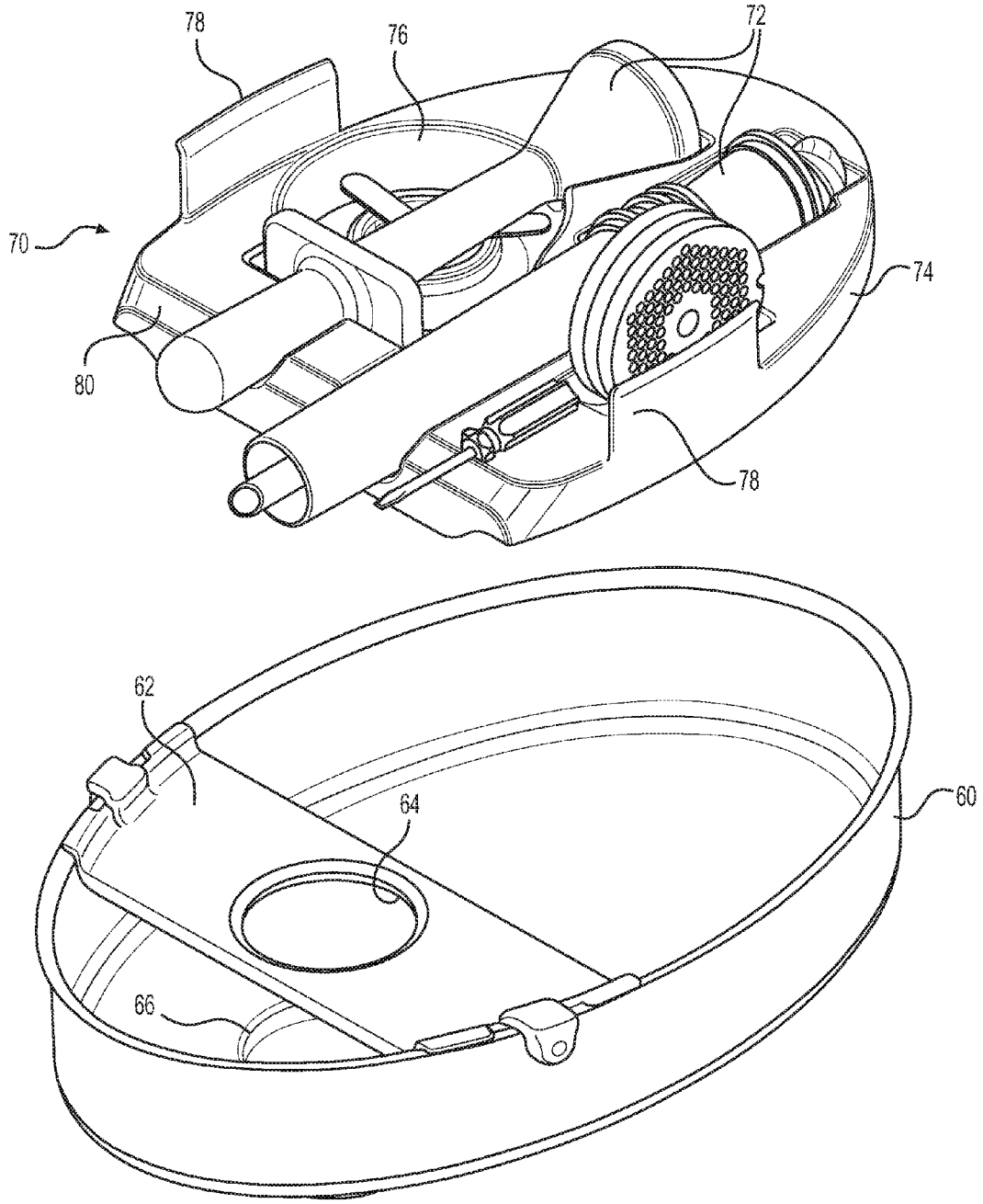
FIG. 7 is a perspective view of a food grinder feeding tray and storage tray holding a plurality of accessories, according to another embodiment of the invention.

Referring now to FIG. 7 (in which much of the food grinder is omitted for clarity), a food grinder of an alternative embodiment of the invention may have a feeding tray 60 that has a guard 62 mounted to the top edge of the feeding tray. Such a guard may be required if the hole 66 that connects to the receiving tube is large enough such that a user's hand may undesirably fit down into the hole 66. In such an embodiment, the guard 62 helps block a user's hand from being inserted into the hole 66. Such a guard 62 typically has a smaller hole 64 situated above the feeding tray hole 66. The guard hole 64 is sized to accept the distal end of a stomper which may be used to push food through feeding tray hole 66. While the guard 62 provides an important safety feature, the guard 62 blocks or restricts some of the open top end of the feeding tray 60. As such, the storage tray 70 of embodiments of the present disclosure is sized and shaped to be selectively insertable into and removable from the feeding tray via the unblocked portion of the open top end. As seen in FIG. 7, the storage tray 70 comprises a main body 74 having a plurality of depressions 76 formed in a top surface thereof. Each depression 76 is sized and shaped to hold one or more accessories 72 for use with the food grinder. The storage tray 70 comprises handles 78 projecting upward from opposing sides of the main body 74. Notably, the storage tray 70 has a truncated edge 80. The truncated edge 80 ensures that the storage tray 70 is the correct size and shape to fit into the unblocked portion of the open top end.

However, the truncated edge 80 shortens the length of the storage tray 70, such that one or more of the accessories may be longer than the storage tray 70. As seen in FIG. 7, one or more of the accessories may overhang the truncated edge 80, such that the overhanging portion extends between the guard 62 and the floor of the feeding tray 60 when the storage tray 70 is inserted into the feeding tray 60. In this regard, the storage tray 70 is still able to accommodate the longer accessories.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the appended claims.

That which is claimed:

1. A food grinder comprising:

a base housing a motor;

a throat portion coupled to the base;

a receiving tube coupled to the throat, the receiving tube for receiving food to be ground and introducing the food to be ground into the throat portion;

a feeding tray coupled to an upper end of the receiving tube, the feeding tray for receiving the food to be ground and introducing the food to be ground into the receiving tube, the feeding tray comprising a floor, a wall projecting upward from a perimeter of the floor, and an open top end;

a selectively rotatable auger selectively insertable into and removable from the throat portion; and a storage tray sized and shaped to be selectively insertable into and removable from the feeding tray via the open top end, the storage tray comprising a main body having a plurality of depressions formed in a top surface thereof, each depression sized and shaped to hold one or more accessories for use with the food grinder.

2. The food grinder of claim 1, wherein the storage tray further comprises one or more handles projecting upward from the main body such that the one or more handles extend above the top end of the feeding tray when the storage tray is selectively inserted into the feeding tray.

3. The food grinder of claim 1, wherein the feeding tray further comprises a guard mounted to a top edge of the wall such that the guard blocks a portion of the open top end of the feeding tray; and wherein the storage tray is sized and shaped to be selectively insertable into and removable from the feeding tray via a portion of the open top end that is not blocked by the guard.

4. The food grinder of claim 3, wherein one or more of the plurality of depressions is shaped, sized, and/or positioned such that at least a portion of at least one accessory overhangs a side edge of the storage tray and extends between the guard and the floor of the feeding tray.

5. The food grinder of claim 1, further comprising:

a cover that is selectively positionable on and removable from the open top end of the feeding tray, such that the cover blocks the open top end when selectively positioned thereon.

6. The food grinder of claim 1, wherein the cover comprises a drawstring for securing the cover to the feeding tray.

* * * * *